US012768109B2

(12) United States Patent
Kvist et al.

(10) Patent No.: US 12,768,109 B2
(45) Date of Patent: Oct. 20, 2026

(54) METHOD FOR IMPROVING GREASE AND OIL RESISTANCE OF A FIBER BASED ARTICLE

(71) Applicant: Kemira Oyj, Helsinki (FI)

(72) Inventors: Markus Kvist, Helsinki (FI); Sami Puttonen, Helsinki (FI); Kimmo Strengell, Helsinki (FI); Leif Robertsén, Helsinki (FI); Matti Hietaniemi, Helsinki (FI)

(73) Assignee: Kemira Oyj, Helsinki (FI)

( * ) Notice: Subject to any disclaimer, the term of this patent is extended or adjusted under 35 U.S.C. 154(b) by 50 days.

(21) Appl. No.: 18/716,972

(22) PCT Filed: Dec. 1, 2022

(86) PCT No.: PCT/FI2022/050804
§ 371 (c)(1),
(2) Date: Jun. 6, 2024

(87) PCT Pub. No.: WO2023/118646
PCT Pub. Date: Jun. 29, 2023

(65) Prior Publication Data

US 2025/0034813 A1 Jan. 30, 2025

(30) Foreign Application Priority Data

Dec. 22, 2021 (FI) ..... 20216325

(51) Int. Cl.
*D21H 21/16* (2006.01)
*D21H 17/17* (2006.01)
(Continued)

(52) U.S. Cl.
CPC ..... *D21H 21/16* (2013.01); *D21H 17/17* (2013.01); *D21H 17/42* (2013.01); *D21H 17/55* (2013.01);
(Continued)

(58) Field of Classification Search
CPC ..... D21H 21/16; D21H 17/17; D21H 17/42; D21H 17/55; D21H 21/28; D21H 23/08;
(Continued)

(56) References Cited

U.S. PATENT DOCUMENTS 5,061,346 A 10/1991 Taggart et al.
11,434,606 B2 9/2022 Uehara et al.
(Continued)

FOREIGN PATENT DOCUMENTS

CA 3240833 A1 6/2023
CN 109056409 A 12/2018
(Continued)

OTHER PUBLICATIONS

Perng, Y.-S. et al. Optimization of Handsheet Grease proof Properties: The Effects of Furnish, Refining, Fillers, and Binders. In: BioResources 7(3), 2012, pp. 3895-3909.
(Continued)

*Primary Examiner* — Rita P Adlakha
*Assistant Examiner* — Elisa H Vera
(74) *Attorney, Agent, or Firm* — Espatent Oy

(57) ABSTRACT

There is provided a method for improving grease and oil resistance of a moulded fiber based article comprising introducing to a fiber stock a composition comprising a synthetic polymer component and a cationic polymer component and thermoforming the fiber stock. There is also provided a moulded fiber based article and a use of the composition improving grease and oil resistance of a moulded fiber based article. There is also provided a method for preparation of a moulded fiber based article.

24 Claims, 2 Drawing Sheets

(51) Int. Cl.

| | |
|---|---|
| ***D21H 17/42*** | (2006.01) |
| ***D21H 17/55*** | (2006.01) |
| ***D21H 21/28*** | (2006.01) |
| ***D21H 23/08*** | (2006.01) |
| ***D21J 3/00*** | (2006.01) |
| ***D21J 5/00*** | (2006.01) |

(52) U.S. Cl.
CPC ..... *D21H 21/28* (2013.01); *D21H 23/08* (2013.01); *D21J 3/00* (2013.01); *D21J 5/00* (2013.01)

(58) Field of Classification Search
CPC ..... D21H 17/375; D21H 17/72; D21H 27/10; D21J 3/00; D21J 5/00; D21J 1/08; B65D 1/34; B65D 65/466
See application file for complete search history.

(56) References Cited

U.S. PATENT DOCUMENTS

| | | | | |
|---|---|---|---|---|
| 2004/0241475 | A1 | 12/2004 | Morabito | |
| 2010/0048768 | A1* | 2/2010 | Solhage | B32B 27/30 524/522 |
| 2010/0059191 | A1 | 3/2010 | Garcia Melgarejo et al. | |
| 2019/0242065 | A1* | 8/2019 | Hietaniemi | D21H 17/71 |
| 2025/0034813 | A1 | 1/2025 | Kvist et al. | |
| 2025/0043513 | A1 | 2/2025 | Kvist et al. | |
| 2025/0389086 | A1 | 12/2025 | Vänskäet al. | |
| 2026/0008210 | A1 | 1/2026 | Vänskä et al. | |

FOREIGN PATENT DOCUMENTS

| | | | |
|---|---|---|---|
| CN | 209128809 | U | 7/2019 |
| CN | 11337 37 38 | A | 9/2021 |
| CN | 118369479 | A | 7/2024 |
| JP | S582208 95 | A | 12/1983 |
| WO | 2010033960 | A1 | 3/2010 |
| WO | 2017103335 | A1 | 6/2017 |
| WO | 2017122728 | A1 | 7/2017 |
| WO | 2018055239 | | 3/2018 |
| WO | 201 8078558 | A1 | 5/2018 |
| WO | 2018229333 | A1 | 12/2018 |
| WO | 2019131048 | A1 | 7/2019 |
| WO | 20191 80302 | A1 | 9/2019 |
| WO | 20210 19468 | A1 | 2/2021 |
| WO | 2025125716 | A1 | 6/2025 |

OTHER PUBLICATIONS

Hubbe, M. A. Contributions of Polyelectrolyte Complexes and Ionic Bonding to Performance of Barrier Films for Packaging: A Review. In: BioResources 16(2), 2021, pp. 4544-4605.

* cited by examiner

METHOD FOR IMPROVING GREASE AND OIL RESISTANCE OF A FIBER BASED ARTICLE

TECHNICAL FIELD

The present disclosure generally relates to a method for increasing grease and oil resistance of a fiber based article. The disclosure relates particularly, though not exclusively, to a method for improving grease and oil resistance of a fiber based article by moulding a fiber stock.

BACKGROUND

This section illustrates useful background information without admission of any technique described herein representative of the state of the art.

Pollution caused by single use plastic containers and packaging materials is epidemic, scarring the global landscape and threatening delicate ecosystems and the life forms that inhabit them. Single use containers migrate along waterways to the oceans in the form of Styrofoam and expanded polystyrene (EPS) packaging, to-go containers, bottles, thin film bags and photo-degraded plastic pellets. Sustainable solutions for reducing plastic pollution are gaining momentum. However, continuing adoption requires that these solutions not only be good for the environment, but also competitive with plastics from both a performance and a cost standpoint.

By way of brief background, molded paper pulp (molded fiber) has been used since the 1930's to make containers, trays and other packages, but experienced a decline in the 1970s after the introduction of fossil based plastic foam packaging. Paper pulp can be produced from old newsprint, corrugated boxes and other plant fibers. Today, molded pulp packaging is widely used for electronics, household goods, automotive parts and medical products, and as an edge/corner protector or pallet tray for shipping electronic and other fragile components.

Cellulose fiber-based packaging products are biodegradable, compostable and, unlike fossil based plastics, do not migrate into the ocean. However, presently known fiber technologies are not well suited for use with meat and poultry, prepared food, produce, microwavable food, or as lids for beverage containers such as hot coffee. In particular, selectively integrating one or more oil, water, vapor, and/or oxygen barriers into the slurry, and/or selectively applying one or more of the barrier layers to all or a portion of the surface of the finished packaging product, can be cumbersome, time consuming, and expensive.

Depending on molded pulp application, oil, grease, water, water vapor, oxygen and/or other gas or liquid barrier properties are needed in different container types. Use of suitable slurry chemicals can improve process efficiency, mechanical properties, barrier properties and/or surface coatability and therefore, make production of molded pulp products more competitive against products made from planar board.

SUMMARY

In a first aspect the present invention provides a method for improving grease and oil resistance of a moulded fiber based article comprising obtaining a fibre stock comprising cellulosic fibers, introducing to the fiber stock a composition comprising a synthetic polymer component, which is a copolymer of acrylamide and at least one anionic monomer, the synthetic polymer component having an anionicity of 1-60 mol-%, and a cationic polymer component, the synthetic polymer component and cationic polymer component providing the composition with a charge density in the range of 0.05-1 meq/g, when measured at pH 2.8, and −0.2--3 meq/g, when measured at pH 7.0, optionally introducing polyamidoamine-epichlorohydrin, glyoxalated polyacrylamide, starch or a mixture thereof to the fiber stock, and moulding the fiber stock.

In a second aspect the present invention provides a moulded fiber based article, wherein the moulded fiber based article comprises a composition comprising a synthetic polymer component, which is a copolymer of acrylamide and at least one anionic monomer, the polymer component having an anionicity of 1-60 mol-%, and a cationic polymer component, the synthetic polymer component and cationic polymer component providing the composition with a charge density in the range of 0.05-1 meq/g, when measured at pH 2.8, and −0.2--3 meq/g, when measured at pH 7.0, optionally polyamidoamine-epichlorohydrin, glyoxalated polyacrylamide, starch or a mixture thereof, and optionally pigment material, or wherein the moulded fiber based article is produced with the method according to the present invention.

In a third aspect the present invention provides a use of a composition comprising a synthetic polymer component, which is a copolymer of acrylamide and at least one anionic monomer, the polymer component having an anionicity of 1-60 mol-%, and a cationic polymer component, the synthetic polymer component and cationic polymer component providing the composition with a charge density in the range of 0.05-1 meq/g, when measured at pH 2.8, and −0.2--3 meq/g, when measured at pH 7.0, and in addition optionally polyamidoamine-epichlorohydrin, glyoxalated polyacrylamide, starch or a mixture thereof, and optionally pigment material for improving grease and oil resistance a moulded fiber based article.

It has now been surprisingly found that moulded, such as thermoformed, fiber based articles comprising a composition comprising a synthetic polymer component and a cationic polymer component, such as cationic starch component, wherein the composition has a special charge density has increased oil resistance. It was surprisingly found that the composition acts as oil barrier in the fiber based article.

It is also believed that the composition acts also as a grease barrier in the fiber based article.

It has been found that the composition gives olive oil resistance, i.e. penetration time and uptake of a moulded fiber based article compared to a moulded fiber based article without the composition. It is also believed that grease resistance is obtained.

It has been also surprisingly found that moulded fiber based articles comprising the composition and polyamidoamine-epichlorohydrin (PAAE), glyoxalated polyacrylamide, starch or a mixture thereof has increased oil resistance. It is also believed that grease resistance is increased.

It has been found that the composition together with polyamidoamine-epichlorohydrin, glyoxalated polyacrylamide, starch or a mixture thereof increased oil resistance of a moulded, such as thermoformed, fiber based article by 60 min compared to a moulded fiber based article without the composition and the polyamidoamine-epichlorohydrin, glyoxalated polyacrylamide or a mixture thereof. It is also believed that grease resistance is also enhanced.

Without bounding to any theory, it is believed that the moulded fiber products comprising the composition comprising the synthetic polymer component and the cationic polymer component, will trap grease and oil components and act as grease and oil barrier.

The fiber-based articles of the present invention are at least partly biodegradable and compostable, preferably mostly biodegradable and compostable, more preferably almost totally biodegradable and compostable, most preferably biodegradable and compostable.

It has been also surprisingly found that moulded fiber based articles having oil and grease resistance can be produced with a simple and low-cost method. It has been found that moulded fiber based articles having oil and grease resistance can be produced by introducing to a fiber stock comprising cellulosic fibers the composition comprising the synthetic polymer component and the cationic polymer component, wherein the composition has a special charge density and optionally introducing polyamidoamine-epichlorohydrin, glyoxalated polyacrylamide, starch or a mixture thereof, and moulding, such as thermoforming, the fiber stock.

It has been surprisingly found that by introducing the composition in high amounts (such as 5-50 kg/t based on dry weight of the fiber stock) to a fiber stock the produced moulded articles have high oil resistance. The oil resistance is increased even more when additionally polyamidoamine-epichlorohydrin, glyoxalated polyacrylamide, starch or a mixture thereof is introduced to the fiber stock. It is also believed that grease resistance is also enhanced.

It is believed that the moulded, such as thermoformed, fiber based articles have improved bending stiffness because it was surprisingly observed that tensile bending stiffness was improved compared to moulded fiber based articles not comprising the composition or the composition and polyamidoamine-epichlorohydrin, glyoxalated polyacrylamide, starch or a mixture thereof. It is believed that the improved tensile index and tensile bending stiffness would enable reducing mass per square of the moulded fiber based article since thickness of the moulded fiber based article could be reduced.

As the thickness and mass per square could be reduced the weight of the moulded fiber based article could be reduced, and therefore reduction in the cost of fibrous raw material.

It is also believed that addition of the composition or the composition and polyamidoamine-epichlorohydrin, glyoxalated polyacrylamide, starch or a mixture thereof to a fiber stock to a process for manufacturing board will provide grease and oil resistance for the board.

It has been also found that addition of pigments and/or other additives to the composition before its addition to the fiber stock improves gloss, smoothness, coatability and/or barrier properties of the moulded fiber based article.

The appended claims define the scope of protection.

DETAILED DESCRIPTION

Figure 1:
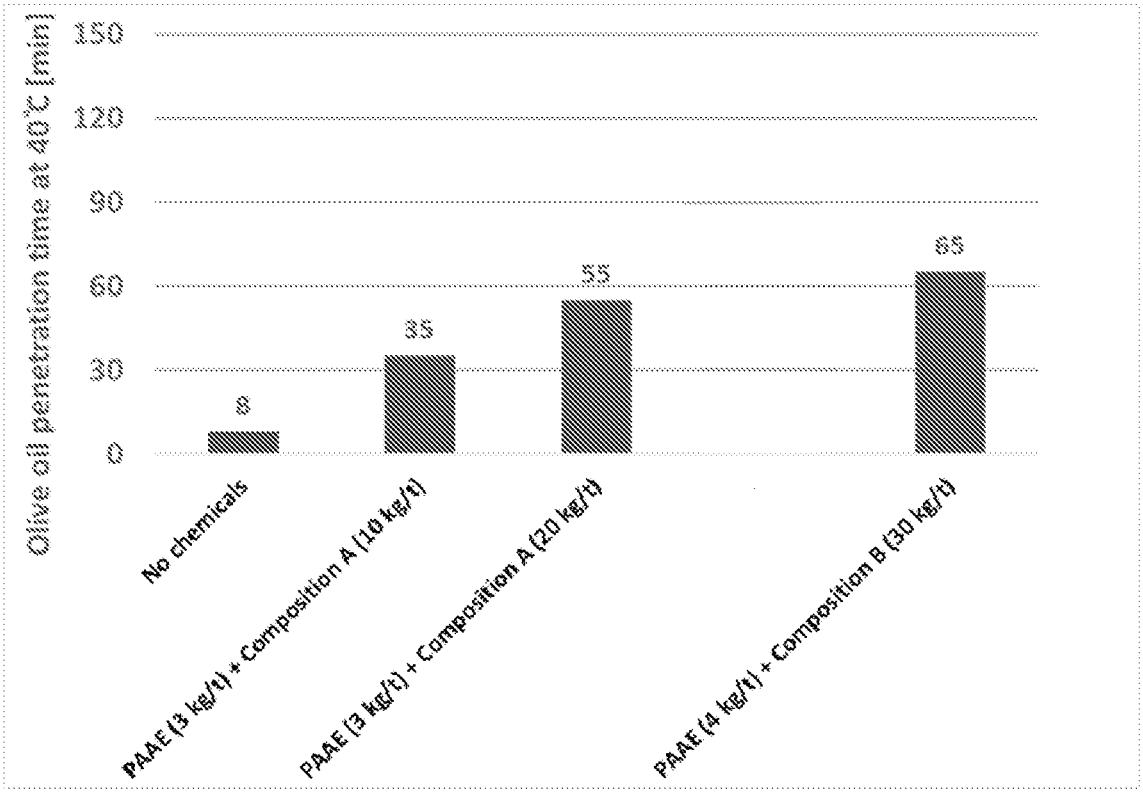
FIG. 1 shows olive oil resistance at 40° C. for the 2D molded fiber article (400 g/m$^2$) after hot press drying and thermoforming (in thickness direction) with the composition (composition B) used in the method of the present invention and comparable composition A.

In a first aspect the present invention provides a method for improving grease and oil resistance of a moulded fiber based article comprising

- obtaining a fibre stock comprising cellulosic fibers,
- introducing to the fiber stock a composition comprising
  - a synthetic polymer component, which is a copolymer of acrylamide and at least one anionic monomer, the polymer component having an anionicity of 1-60 mol-%, and
  - a cationic polymer component,
- the synthetic polymer component and cationic polymer component providing the composition with a charge density in the range of
  - 0.05-1 meq/g, when measured at pH 2.8, and
  - −0.2-−3 meq/g, when measured at pH 7.0,
- optionally introducing polyamidoamine-epichlorohydrin, glyoxalated polyacrylamide, starch or a mixture thereof to the fiber stock, and
- moulding the fiber stock.

The synthetic polymer component and the cationic polymer component of the composition provide the charge densities to the composition.

In one embodiment polyamidoamine-epichlorohydrin (PAAE), glyoxalated polyacrylamide, starch or a mixture thereof is introduced to the fiber stock, preferably polyamidoamine-epichlorohydrin is introduced to the fiber stock.

In one embodiment pigment material is introduced to the fiber stock. In one embodiment the pigment material is introduced to the fiber stock before addition of the composition.

In one embodiment the pigment material is introduced to the fiber stock after addition of the composition. In one embodiment the pigment material is introduced to the fiber stock at the same time as the composition.

In one embodiment the pigment material and the composition are introduced as a mixture to the fiber stock.

In one embodiment amount of the pigment material comprises talc, kaolin clay, calcium carbonate or a mixture thereof.

The moulding, i.e. moulding step or moulding process, can be any suitable method known in the art.

In one embodiment the moulding comprises wet forming, wet moulding, vacuum forming, vacuum moulding, extrusion forming, extrusion moulding, thermoforming, dry moulding, hot pressing, hot press drying, hot moulding, heat pressing, heat moulding, thermomoulding or a combination thereof, preferably thermoforming, more preferably heat pressing, hot pressing, hot press drying or thermomoulding.

In one embodiment the fiber stock is moulded to a sheet.

In one embodiment the fiber stock is formed to a sheet, preferably thermoformed to a sheet.

In the context of the present application by term "sheet" is meant an article having smaller thickness than length and width.

In the context of the present application by term "two-dimensional, 2D, article" is meant a 2D-article originally been made to planar shape and has a smaller thickness than length and width. The 2D-article can be folded or bended to a three-dimensional, 3D, article.

In the context of the present application by term "three-dimensional, 3D, article" is meant an article having three dimensions.

In the context of the present application a sheet is not considered to be a three-dimensional, 3D, article.

In one embodiment the sheet is formed to a three-dimensional, 3D, article.

In one embodiment the fiber stock is moulded to a three-dimensional, 3D, article.

In one embodiment the fiber stock with or without foam is vacuum formed, extrusion formed, wet pressed and/or drained by help of vacuum, unrestrained and/or restrained dried, compacted in one or more directions, polymer impregnated, polymer laminated, polymer coated or a combination thereof, to a two-dimensional, 2D, sheet having thickness of 0.1 mm-10 mm, preferably 0.3 mm-2 mm. In one embodiment the 2D sheet is further thermoformed (i.e. dry moulded, i.e. dry formed) to a three-dimensional, 3D, article having preferably length and width of 5 cm-50 cm, depth of 2 cm-20 cm and wall thickness of 0.1 mm-2 mm.

In one embodiment the fiber stock is wet moulded and the wet moulded fiber stock is moulded to a three-dimensional, 3D, article.

In one embodiment temperature of mould(s) in heat pressing, hot pressing, hot press drying, thermoforming or thermomoulding is 100° C.-400° C., preferably 130° C.-200° C.

In one embodiment mechanical pressure applied on fiber stock or two- or three-dimensional fiber based article in heat pressing, hot pressing, hot press drying, thermoforming or thermomoulding is 0.1 bar-1000 bar, preferably up to 20 bar and pressure can alternate during heat pressing, hot pressing, hot press drying, thermoforming or thermomoulding depending on manufacturing technology, equipment and moulded fiber product application.

In one embodiment the moulding is thermoforming, heat pressing, thermomoulding, wet or dry moulding and/or wet or dry forming to form densifying or a combination thereof, to a three dimensional article.

In one embodiment the polyamidoamine-epichlorohydrin, glyoxalated polyacrylamide, starch or a mixture thereof and the composition are introduced sequentially to the fiber stock, preferably the polyamidoamine-epichlorohydrin, glyoxalated polyacrylamide, starch or a mixture thereof is introduced to the fiber stock before introducing the composition to the fiber stock.

In one embodiment the composition is introduced to the fiber stock followed by introducing the polyamidoamine-epichlorohydrin, glyoxalated polyacrylamide, starch or a mixture thereof to the fiber stock.

In one embodiment the synthetic polymer component and the cationic polymer component are introduced sequentially to the fiber stock, preferably the cationic polymer component is introduced to the fiber stock before introducing the synthetic polymer component to the fiber stock.

In one embodiment the synthetic polymer component is introduced to the fiber stock followed by introducing the cationic polymer component.

In one embodiment the synthetic polymer component, the cationic polymer component and the polyamidoamine-epichlorohydrin, glyoxalated polyacrylamide, starch or a mixture thereof are introduced sequentially to the fiber stock.

In one embodiment the synthetic polymer component and the cationic polymer component are introduced sequentially to the fiber stock followed by introducing the polyamidoamine-epichlorohydrin, glyoxalated polyacrylamide, starch or a mixture thereof to the fiber stock.

In one embodiment the polyamidoamine-epichlorohydrin, glyoxalated polyacrylamide, starch or a mixture thereof is introduced to the fiber stock followed by introducing the synthetic polymer component and the cationic polymer component sequentially to the fiber stock.

In one embodiment the synthetic polymer component is introduced to the fiber stock followed by introducing the polyamidoamine-epichlorohydrin, glyoxalated polyacrylamide, starch or a mixture thereof to the fiber stock followed by introducing the cationic polymer component to the fiber stock.

In one embodiment the cationic polymer component is introduced to the fiber stock followed by introducing the polyamidoamine-epichlorohydrin, glyoxalated polyacrylamide, starch or a mixture thereof to the fiber stock followed by introducing the synthetic polymer component to the fiber stock.

In one embodiment the composition comprises both anionic groups mainly originating from the synthetic polymer component as well as cationic groups mainly originating from the cationic polymer component, such as cationic starch component. The net charge of the composition is carefully selected to provide optimal behaviour at different pH values encountered during preparation, storage and/or transport of composition as well as usage of the composition.

In one embodiment of the invention the synthetic polymer component and cationic polymer component, such as cationic starch component, provide the composition with a charge density in the range of 0.1-0.5 meq/g, preferably 0.15-0.3 meq/g, when measured at pH 2.8, and −0.4--2.0 meq/g, preferably −0.5--1.5, when measured at pH 7.0. According to one embodiment of the invention the composition may have a charge density of −0.3--3.0 meq/g, preferably −0.4--3.0 meq/g, more preferably −0.5--3.0 meq/g, when measured at pH 7.0. The defined charge density at pH <3.5 is suitable to provide easy handling of the composition, and at pH >3.5 the charge density is sufficient to ensure the presence of anionic charges in order to provide an effective interaction both with cationic polymer component as well as the fibres and fillers in the stock.

In a preferred embodiment the composition has anionic net charge already at pH 5.5, preferably already at pH 5.0, more preferably already at pH 4.5.

When the pH value of the composition is <3.5 the charge density of the composition originates mainly from the cationically charged groups of the cationic polymer component, such as cationic starch component. The charge density of composition at pH values >3.5 originates mainly from the anionically charged groups of the synthetic polymer component. The synthetic polymer component may have a charge density of −0.3--7 meq/g, preferably −0.5--5 meq/g, more preferably −1--3 meq/g, even more preferably −1--2 meq/g, at pH 7, i.e. it is anionic at pH 7.

In one embodiment of the composition may have a pH value <3.5 and a dry solids content in the range of 5-30 weight-%, preferably 10-20 weight-%, more preferably 12-17 weight-% during its manufacture, transport and/or storage. At acidic pH values <3.5 the anionic groups of the polymer component are in acid form. When the pH value decreases, the interaction between the anionic groups of the synthetic polymer component and the cationic polymer component decreases. For example at pH values <3.2 anionic groups of the synthetic polymer component are almost free or completely free from interaction with the charged cationic polymer component. This provides a low viscosity for easy preparation and handling of the composition, even at high solids content. The high solids content of the composition is economical in view of storage and transport, as the same amount of active components requires less space. The pH of the composition may be adjusted to a value <3.5 by addition of an acid.

In one embodiment when the composition is ready for addition to the fibre stock, it is diluted with water and it may have an end pH value in the range of 3.8-6.0, preferably 4-5.5, and a dry solids content of <10 weight-%, preferably <5 weight-%, more preferably 0.5-4.5 weight-% after the dilution. Typically the composition may show both cationic and anionic charges at the end pH, i.e. at the pH of addition. The defined charge density at pH >3.5 is sufficient to provide an effective interaction both with the cationic polymer component as well as the fibres and/or fillers in the stock. Furthermore, it has been observed that when the composition has a solids content <10 weight-% it may be effectively mixed with the stock in the wet-end of a paper or board machine. The solids content of <5% is especially preferable when the starch component comprises non-degraded starch.

In one embodiment the composition comprises 10-90 weight-%, preferably 30-70 weight-%, more preferably 40-60 weight-%, of the synthetic polymer component, and 10-90 weight-%, preferably 30-70 weight-%, more preferably 40-60 weight-% of the cationic polymer component, such as cationic starch component, calculated from the dry weight of the composition. In one preferable embodiment the ratio of the synthetic polymer component to the cationic polymer component, such as cationic starch component, is 40:60-60:40, given as dry weights. The ratio of the synthetic polymer to the cationic polymer component is chosen so that the composition is net anionic at the pH of the fibre stock.

The composition comprises a synthetic polymer component, which may be a copolymer of acrylamide and at least one anionic monomer. The copolymer may be linear or crosslinked. The synthetic polymer may be prepared by any suitable polymerisation method, such as solution polymerisation, dispersion polymerisation, emulsion polymerisation, gel polymerisation or bead polymerisation. In one embodiment the synthetic polymer component of the composition is prepared by polymerisation of acrylamide and at least one anionic monomer, which is selected from unsaturated mono- or dicarboxylic acids or their salts, such as acrylic acid, methacrylic acid, maleic acid, itaconic acid, crotonic acid, isocrotonic acid, and any of their mixtures. Preferably, the synthetic polymer component is prepared by solution polymerisation of acrylamide and acrylic acid.

In case the synthetic polymer component is crosslinked, a cross-linker is used in the polymerisation in amount of 100-1000 mg/kg monomers, preferably 100-500 mg/kg monomers. Suitable cross-linkers are, for example, methylenebisacrylamide, ethylene glycol divinyl ether, di(ethylene glycol) divinyl ether, tri (ethylene glycol) divinyl ether, methylenebisacrylamide being preferred.

According to one embodiment the synthetic polymer component is non-crosslinked or only slightly crosslinked by using a cross-linker in the polymerisation in amount of 0.25-100 mg/kg monomers, preferably 0.5-10 mg/kg monomers. preferably 0.75-5 mg/kg monomers.

The synthetic polymer component may have an anionicity of 3-40 mol-%, preferably 5-18 mol-%, more preferably 9-15 mol-%. The anionicity relates to the amount of structural units in the synthetic polymer component which originate from anionic monomers. Anionicity of the synthetic polymer component is selected to optimise the binding of the composition to the fibres, fillers and/or optional other constituents in the stock. In case the amount of units originating from anionic monomers is too low, the composition does no show the desired anionic net charge, whereby the desired binding effect is not obtained. On the other hand, if the amount of units originating from anionic monomers is too high, the dosage needed is too small to induce the desired effect.

In one embodiment of the invention the synthetic polymer component, preferably prepared by solution polymerisation, may have a weight average molecular weight, MW, >300 000 g/mol, preferably >500 000 g/mol. Preferably the weight average molecular weight of the synthetic polymer component may be in the range of 300 000-1 000 000 g/mol, more preferably 400 000-1 000 000 g/mol, even more preferably 500 000-900 000 g/mol. The average molecular weight of the synthetic polymer component is carefully selected in order to provide optimal function in the composition. It has been observed that in case the average molecular weight is too high, the viscosity of the composition becomes easily too high at useful solid content, or the solid content becomes too low if useful viscosity is desired.

In one embodiment the synthetic polymer component is obtained by adiabatic gel polymerisation followed by drying, by bead polymerisation in a solvent or by emulsion polymerisation or dispersion polymerisation in aqueous salt medium and has an average molecular weight MW in the range of 2 000 000-18 000 000 g/mol, preferably 4 000 000-10 000 000 g/mol.

In this application the value "average molecular weight" is used to describe the magnitude of the polymer chain length and it indicates the weight average molecular weight of the polymer. Average molecular weight values are calculated from intrinsic viscosity results measured in a known manner in 1N NaCl at 25° C. by using an Ubbelohde capillary viscometer. The capillary selected is appropriate, and in the measurements of this application an Ubbelohde capillary viscometer with constant K=0.005228 was used. The average molecular weight is then calculated from intrinsic viscosity result in a known manner using Mark-Houwink equation $[\eta]=K\cdot M^{a}$, where $[\eta]$ is intrinsic viscosity, M molecular weight (g/mol), and K and a are parameters given in Polymer Handbook, Fourth Edition, Volume 2, Editors: J. Brandrup, E. H. Immergut and E. A. Grulke, John Wiley & Sons, Inc., USA, 1999, p. VII/11 for poly(acrylamide). Accordingly, value of parameter K is 0.0191 ml/g and value of parameter a is 0.71. The average molecular weight range given for the parameters in used conditions is 490 000-3 200 000 g/mol, but the same parameters are used to describe the magnitude of molecular weight also outside this range. For polymers having a low average molecular weight, typically around 1 000 000 g/mol or less, the average molecular weight is measured by using Brookfield viscosity measurement at 10% polymer concentration at 23° C. temperature. Molecular weight [g/mol] is calculated from formula 1000 000*0.77*ln(viscosity [mPas]). In practice this means that for polymers which the Brookfield viscosity can be measured and the calculated value is less than <1 000 000 g/mol, the calculated value is the accepted MW value. If the Brookfield viscosity cannot be measured or the calculated value is over 1 000 000 g/mol, the MW values are determined by using intrinsic viscosity as described above.

The composition comprises, in addition to synthetic polymer component, a cationic polymer component, such as a cationic starch component, which is of natural origin. In one embodiment the cationic starch component is cationic non-degraded starch. In the present context this means starch, which has been modified solely by cationisation, and which is non-degraded and non-cross-linked. In one embodiment the cationic starch component comprises starch units of which at least 70 weight-%, preferably at least 80 weight-%, more preferably at least 85 weight-%, even more preferably at least 90 weight-%, sometimes even more preferably at least 95 weight-%, have an average molecular weight MW over 20 000 000 g/mol, preferably over 50 000 000 g/mol, more preferably over 100 000 000 g/mol, sometimes even over 200 000 000 g/mol. When the cationic starch component is non-degraded, the length of the starch molecules provides successful three-dimensional network effect, and an optimal interaction with the synthetic polymer component as well as with other constituents of the fibre stock, e.g. fibres and/or inorganic fillers, as well as cationic strength agents that has been separately added to the fibre stock.

The cationic starch component may be potato, waxy potato, rice, corn, waxy corn, wheat, barley, sweet potato or tapioca starch. Preferably the cationic starch component is waxy corn starch and waxy potato starch. According to one preferable embodiment the cationic starch component has an amylopectin content >70%, preferably >80%, more preferably >85, even more preferably >90%, sometimes even more preferably >95%.

The cationic starch component is in form of an aqueous solution, which means that the starch has been dissolved in water, e.g. by cooking. The cooking may be performed at temperature of 60-135° C.

Starch may be cationised by any suitable method. Preferably starch is cationised by using 2,3-epoxypropyltrimethylammonium chloride or 3-chloro-2-hydroxypropyltrimethylammonium chloride, 2,3-epoxypropyltrimethylammonium chloride being preferred. It is also possible to cationise starch by using cationic acrylamide derivatives, such as (3-acrylamidopropyl)-trimethylammonium chloride.

The cationic starch component may have a substitution degree of 0.025-0.3, preferably 0.03-0.16, more preferably 0.045-0.1. The substitution degree is relative to the cationicity of the starch. Cationic starches having relatively high cationicity as defined are preferred for use in the composition.

In one preferable embodiment the composition is free of cationic synthetic polymers.

The composition is a mixture of a synthetic polymer component and a cationic polymer component, such as cationic starch component. The components of the composition may be mixed with each other before the addition of the composition to the fibre stock, i.e. the composition is added to the stock as a single solution. In the present context mixture of a synthetic polymer component and a cationic polymer component is understood as a blend or combination of an existing synthetic polymer component and a starch component. Both components are in form of a solution or dispersion at the time of mixing. In other words, a mixture is not to be interpreted to cover compositions obtained by polymerising monomers of a synthetic polymer in the presence of a cationic polymer component thereby forming starch grafts.

In one embodiment the composition can be prepared by effective mixing of the cationic polymer component, such as cationic starch component into a solution of synthetic polymer component, preferably at pH <3.5. If the pH is higher than 4.5 at the mixing, there may be a risk for gel formation, especially if the solids content of the composition is >12 weight-%.

The synthetic polymer component may be in form of an aqueous solution or dispersion when it is mixed with the starch component.

In one embodiment solutions of cationic polymer component, such as cationic starch component, and the polymer component, which both have solids concentration <12 weight-%, preferably <10 weight-%, may be mixed with each other before the addition to the stock. Preferably the cationic polymer component and the synthetic polymer component are allowed to interact with each other before the composition is added to the fibre stock in order to guarantee the formation of the polyionic complex.

In one embodiment of the invention the composition may be prepared on-site. This means that the synthetic polymer component and the cationic polymer component may be transported separately, even as dry products, to the site of use. At the site of use the synthetic polymer component and the cationic polymer component are optionally dissolved and/or diluted and prepared into the aqueous composition by mixing. This reduces the risk of degradation of the composition during transportation and storage. Especially cationic starch component may be vulnerable to microbiological degradation, which could lead to loss of performance.

The composition has a pH value <3.5, preferably <3, when it is prepared or stored as a storage solution with high solids content, for example >10 weight-%. It has been observed that the low pH improves the mixing of the synthetic anionic polymer component to the cationic polymer component and provides homogenous composition with desired viscosity. In one preferable embodiment the composition has a Brookfield viscosity of <10 000 mPas, preferably <8000 mPas, more preferably <6000 mPas, at pH 3.0 and at solids content of 14 weight-%. According to one embodiment the viscosity of the composition is in the range of 2000-10 000 mPas, preferably 2500-6500 mPas, at pH 3.0 and at solids content of 14 weight-%. The viscosity values are measured at room temperature by using Brookfield DV-I+, small sample adapter, 20 spindle 31, maximum rpm. The viscosity of the composition at high solids content at pH <3.5 is suitable for proper handling of the composition in an industrial process, for example, enabling pumping of the composition and its dilution by mixing.

In general the composition has an anionic net charge from pH value about 3.8 upwards. Polyionic complex, which results from the interaction of the cationic polymer component and the synthetic polymer component, may be formed already in great extent at pH about 3.2. When the composition having a pH value <3.5 and a high solids content, e.g. >10 weight-%, is diluted with water, the pH of the composition changes simultaneously with the added water. Alternatively, the pH of the composition may be adjusted by addition of a base. The composition is normally diluted with water and the pH is adjusted, either by dilution or by addition of base, to obtain a composition solution, which has pH value >3, preferably at least 3.5, more preferably 3.5-4.0, before the addition of the composition to the fibre stock. When the pH of the composition exceeds pH 5, the net charge of the composition is anionic. At pH 7 the composition has always anionic net charge.

In one embodiment an amphoteric polymer having both anionic and cationic groups providing the charge density in the range of 0.05-1 meq/g, when measured at pH 2.8, and −0.2--3 meq/g, when measured at pH 7.0 is introduced to the fiber stock, preferably instead of the composition.

In one embodiment an IPN (interpenetrating polymer network) material providing the charge density in the range of 0.05-1 meq/g, when measured at pH 2.8, and −0.2-−3 meq/g, when measured at pH 7.0 is introduced to the fiber stock, preferably instead of the composition.

In one embodiment a polymer having both anionic and cationic groups, preferably amphoteric polymer and/or an interpenetrating polymer network material providing the charge densities is/are introduced to the fiber stock, preferably instead of the composition.

In one embodiment the composition is introduced in an amount of 5-50 kg/t, preferably 10-35 kg/t, more preferably 15-30 kg/t, even more preferably, based on dry weight of the fiber stock.

In one embodiment the polyamidoamine-epichlorohydrin, glyoxalated polyacrylamide or a mixture thereof is introduced in amount of 1 kg/t-8 kg/t, preferably 2 kg/t-6 kg/t, more preferably 2 kg/t-4 kg/t as dry weight, based on the dry weight of the fiber stock.

In one embodiment the starch comprises native starch, cooked starch, uncooked starch, cationic starch, native chemically modified starch, physically modified polymer grafted starch, enzyme modified starch, anionic starch, amphoteric starch, crosslinked starch, pre-gelled starch, swelled starch, granule starch or a mixture thereof.

In one embodiment the starch is introduced in an amount of 1 kg/t-100 kg/t as dry weight, based on the dry weight of the fiber stock.

In one embodiment cationic starch is introduced in an amount of 4 kg/t-20 kg/t as dry weight, based on the dry weight of the fiber stock.

In one embodiment the non-ionic starch is introduced in an amount of 1 kg/t-100 kg/t as dry weight, based on the dry weight of the fiber stock.

In one embodiment before introducing the composition and the polyamidoamine-epichlorohydrin, glyoxalated polyacrylamide, starch or a mixture thereof to the fiber stock pH of the fiber stock is adjusted to pH value 5-9, preferably 7-8.

In one embodiment conductivity of the fiber stock is adjusted to 0.1 mS/cm-3 mS/cm, preferably 0.1 mS/cm-1 mS/cm before introducing the composition and the polyamidoamine-epichlorohydrin, glyoxalated polyacrylamide, starch or a mixture thereof to the fiber stock. In one embodiment the conductivity is adjusted with a composition comprising 70% calcium acetate, 20% sodium sulphate and 10% sodium bicarbonate.

In one embodiment sizing chemical, fixative, wet strength agent, drainage aid or a mixture thereof is introduced to the fiber stock after or before introducing the composition and polyamidoamine-epichlorohydrin, glyoxalated polyacrylamide, starch or a mixture thereof to the fiber stock.

In one embodiment sizing chemical, fixative, wet strength agent, drainage aid or a mixture thereof is introduced to the fiber stock before introducing the composition and polyamidoamine-epichlorohydrin, glyoxalated polyacrylamide, starch or a mixture thereof to the fiber stock.

In one embodiment sizing chemical, fixative, wet strength agent, drainage aid or a mixture thereof is introduced to the fiber stock after introducing the composition and polyamidoamine-epichlorohydrin, glyoxalated polyacrylamide, starch or a mixture thereof to the fiber stock.

In one embodiment polyamidoamine-epichlorohydrin, glyoxalated polyacrylamide, starch or a mixture thereof is introduced to the fiber stock before introducing a sizing chemical to the fiber stock.

In one embodiment a sizing chemical, polyamidoamine-epichlorohydrin, glyoxalated polyacrylamide, starch or a mixture thereof is introduced to the fiber stock at the same time but separately.

In one embodiment a sizing chemical, polyamidoamine-epichlorohydrin, glyoxalated polyacrylamide or a mixture thereof is introduced to the fiber stock as a mixture.

In one embodiment the sizing chemical comprises alkyl ketene dimer (AKD), alkenyl succinic anhydride (ASA), rosin or a mixture thereof.

In one embodiment AKD, ASA, rosin or a mixture thereof and polyamidoamine-epichlorohydrin, glyoxalated polyacrylamide, starch or a mixture thereof are introduced as a mixture to the fiber stock, preferably before introducing the composition to the fiber stock.

In one embodiment AKD, ASA, rosin or a mixture thereof and polyamidoamine-epichlorohydrin, glyoxalated polyacrylamide, starch or a mixture thereof are introduced as a mixture to the fiber stock, preferably after introducing the composition to the fiber stock.

In one embodiment AKD, ASA, rosin, polyamidoamine-epichlorohydrin, glyoxalated polyacrylamide, starch or a mixture thereof are introduced as a mixture to the fiber stock, preferably before introducing the composition to the fiber stock.

In one embodiment AKD, ASA, rosin, polyamidoamine-epichlorohydrin, glyoxalated polyacrylamide, starch or a mixture thereof are introduced as a mixture to the fiber stock, preferably after introducing the composition to the fiber stock.

In one embodiment AKD, ASA, rosin or a mixture thereof is introduced in an amount of 0.1-4%, preferably 0.5-1.5% based on dry weight of the fiber stock.

In one embodiment polyamidoamine-epichlorohydrin, glyoxalated polyacrylamide or a mixture thereof is introduced in an amount of 1-8 kg/t, preferably 2-4 kg/t as dry weight, based on dry weight of the fiber stock.

In one embodiment the fixative, drainage aid or a mixture thereof comprises aluminium sulphate (ALS), polyaluminium chloride (PAC), poly(diallyldimethylammonium chloride) (PDACMAC), cationic polyacrylamide (CPAM) or a mixture thereof.

In one embodiment the wet strength agent comprises polyamide-epichlorohydrin (PAE), glyoxalated polyacrylamide (GPAM), starch or a mixture thereof. In one embodiment the wet strength agent is added after addition of a sizing agent but before addition of the composition to the fiber stock.

In one embodiment consistency of the obtained fiber stock comprising cellulosic fibers is 0.1%-10%, preferably 0.2%-0.1%, more preferably 0.2%-0.5%.

In one embodiment the fiber stock comprising cellulosic fibers comprises natural fibers, synthetic fibers or a mixture thereof. Preferably the fibers are plant origin comprising recycled, chemical and/or mechanical hardwood and softwood pulps, sugar cane (such as bagasse), bamboo, marley, wheat, maize, corn, oats, barley, rice, rye, tomato, sorghum, rape seed, palm oil plants, flax, hemp, ramie, cotton, kenaf, jute, banana, cannabis, peat, moss or a mixture thereof.

In one embodiment the cationic polymer component comprises starch derivate such as hydroxypropylated starch, nanocellulose, microfibrillated cellulose, lignocellulose based derivatives, chitosan, alfaglucan, polyhydroxy alkanoate, polylactic acid, cationic starch or a mixture thereof, preferably cationic starch, chitosan, nanocellulose, microfibrillated cellulose, lignocellulose based derivatives or a mixture thereof.

In a second aspect the present invention provides a moulded fiber based article, wherein the moulded fiber based article comprises a composition comprising a synthetic polymer component, which is a copolymer of acrylamide and at least one anionic monomer, the polymer component having an anionicity of 1-60 mol-%, and a cationic polymer component, the synthetic polymer component and cationic polymer component providing the composition with a charge density in the range of 0.05-1 meq/g, when measured at pH 2.8, and −0.2--3 meq/g, when measured at pH 7.0.

optionally polyamidoamine-epichlorohydrin, glyoxalated polyacrylamide, starch or a mixture thereof, and optionally pigment material.

In one embodiment the moulded fiber based article comprises polyamidoamine-epichlorohydrin, glyoxalated polyacrylamide, starch or a mixture thereof.

In one embodiment the moulded fiber based article comprises pigment material.

In one embodiment the moulded fiber based article is thermoformed fiber based article, preferably hot pressed, hot pressed dried, heat pressed fiber based article or thermo-moulded fiber based article.

In one embodiment amount of the fiber in the moulded fiber based article is 50 wt. %-99 wt. %, preferably 80 wt. %-97 wt. %, more preferably 90 wt. %-97 wt. %, based on dry weight of the moulded fiber based article.

In one embodiment amount of the composition in the moulded fiber based article is 0.5 wt. %-10 wt. %, preferably 1.5 wt. %-3 wt. %, based on the dry weight of the moulded fiber based article.

In one embodiment amount of the polyamidoamine-epichlorohydrin, glyoxalated polyacrylamide, starch or a mixture thereof in the moulded fiber based article is 0.05 wt. %-0.8 wt. %, preferably 0.2 wt. %-0.4 wt. %, based on dry weight of the moulded fiber based article.

In one embodiment amount of the pigment material in the moulded fiber based article is 0.01 wt. %-5 wt. %, preferably 0.5 wt. %-4 wt. %, based on dry weight of the moulded fiber based article.

In one embodiment the moulded fiber based article comprises a sizing chemical, fixative or a mixture thereof.

In one embodiment the moulded fiber based article comprises a sizing chemical, fixative, drainage aid or a mixture thereof. In one embodiment amount of the sizing chemical, fixative, drainage aid or a mixture thereof in the moulded fiber based article is 0.1 wt. %-5 wt. %, preferably 0.5 wt. %-2.0 wt. %, based on dry weight of the moulded fiber based article.

In one embodiment the moulded fiber based article comprises food packages, food service items, drink packages, drink service items, goods packages, goods service items, preferably food service and packaging items such as ovenable trays, microwavable trays, clamshell boxes, other food boxes, soup cups, fresh meet and poultry trays, plates or cup lids.

In one embodiment the moulded fiber based article is produced with the method of the present invention.

In a third aspect the present invention provides a use of a composition comprising a synthetic polymer component, which is a copolymer of acrylamide and at least one anionic monomer, the polymer component having an anionicity of 1-60 mol-%, and a cationic polymer component, the synthetic polymer component and cationic polymer component providing the composition with a charge density in the range of 0.05-1 meq/g, when measured at pH 2.8, and −0.2--3 meq/g, when measured at pH 7.0, and in addition optionally polyamidoamine-epichlorohydrin, glyoxalated polyacrylamide, starch or a mixture thereof, and optionally pigment material for improving grease and oil resistance of a moulded fiber based article.

In one embodiment the polyamidoamine-epichlorohydrin, glyoxalated polyacrylamide, starch or a mixture thereof is used in addition to the composition for improving grease and oil resistance of a thermoformed fiber based article.

In one embodiment the pigment material is used in addition to the polyamidoamine-epichlorohydrin, glyoxalated polyacrylamide, starch or a mixture thereof and the composition for improving grease and oil resistance of a thermoformed fiber based article.

In one embodiment a sizing chemical, wet strength agent, fixative, drainage aid or a mixture thereof is used in addition to the polyamidoamine-epichlorohydrin, glyoxalated polyacrylamide, starch or a mixture thereof, the composition and the pigment material for improving grease and oil resistance of a thermoformed fiber based article.

EXAMPLES

Example 1 According to the Present Invention 0.1-0.3% (by dry weight) of AKD is first added to fiber stock with 0-3-0.5% consistency made from 100% birch kraft pale pulp. Then 0.3-0.5% (by dry weight) of polyamide-epichlorohydrin (PAAE) is added to fiber stock. Then 2-3% (by dry weight) of the composition (composition B) comprising at least one synthetic anionic polymer having molecular weight of 300-900 kDa and cationic polymer is added to the fiber stock. After addition of each chemical to the fiber stock the stock is mixed for at least 1 minute under turbulent conditions before addition of next chemical and vacuum forming.

Example 2, Comparative Example(s)

Same method and chemicals were used to prepare and determine characteristics of a 2D molded fiber article/sheet as in Example 1 but instead of composition B, comparable composition A was used which was a mixture of an anionic polymer having molecular weight of 300-700 kDa and a cationic polymer.

Preparation of Two-Dimensional, 2D, Article/Sheet

Figure 2:
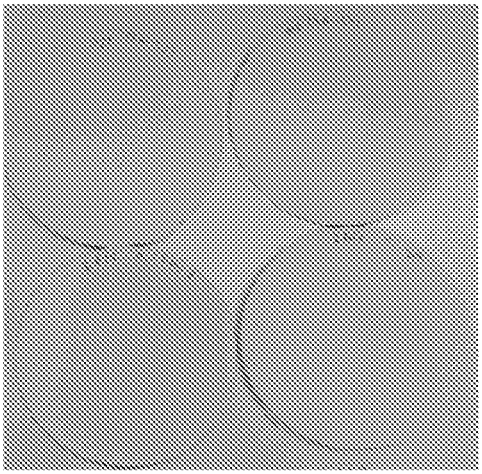
FIG. 2 shows thermoformed fiber based two-dimensional articles/sheets.

After introducing the chemicals according to example 1 and 2 to the fiber stock the fiber stock is vacuum formed to dryness of 20-30% using dynamic drainage analyzer under 200-500 mBar vacuum against planar round shaped 10 cm in diameter, forming wire with 200-400 micron openings. Wet 2D article/sheet with grammage of 200-800 g/m$^2$ as dry is then hot press dried and thermoformed to 0.2-0.8 mm thickness between 130-200° C. metal plates until dryness of 94-99% is reached. Hot press dried and thermoformed 2D moulded fiber articles/sheets are shown in FIG. 2.

The 2D fiber moulded article may be hot pressed and/or thermoformed to a density of 0.5 g/cm$^3$-1.5 g/cm$^3$, preferably 1.0-1.2 g/cm$^3$ and thickness of 0.1-1.2 mm, preferably 0.2-0.8 mm.

Preparation of Three-Dimensional, 3D, Article

Figure 3:
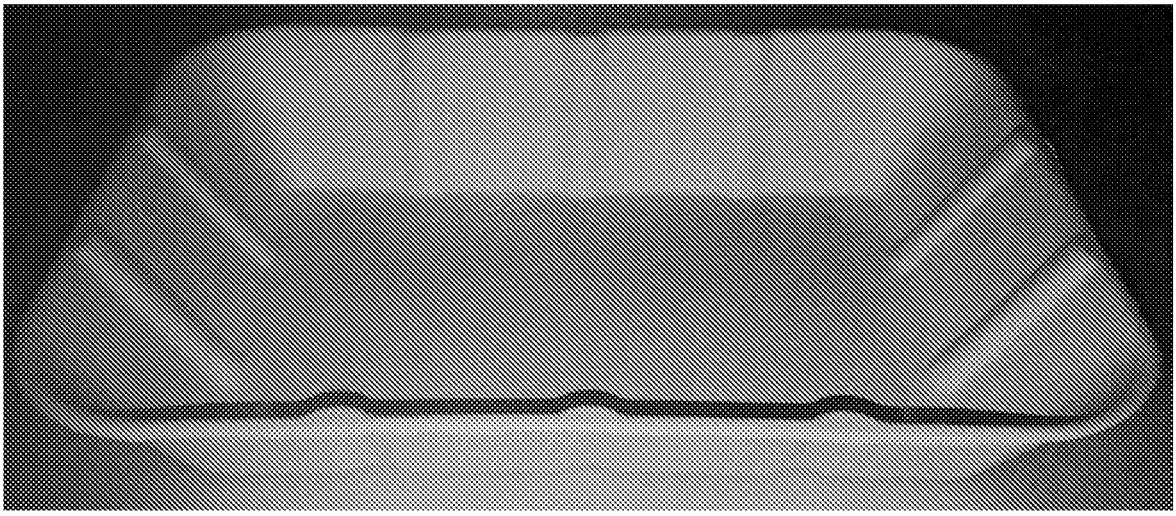
FIG. 3 shows wet molded and thermoformed fiber based three-dimensional article.

After introducing the chemicals to the fiber stock a 3D shaped forming wire with suction mould is dipped into the fiber stock and fiber stock material is drawn/formed against the 3D wire with 200-400 micron openings under up to 900 mBar vacuum. Formed 3D article is lifted up from the fiber stock and vacuum suction assisted drainage is continued until dryness of wet moulded 3D article is 33% on average. Wet moulded 3D article is then transferred on to heated counter mould (130-200° C.) and hot press dried and thermoformed to 0.2-1.2 mm thickness and final dryness of 94-96%. Dried 3D moulded fiber article is shown in FIG. 3.

The 3D article may be hot press dried and thermoformed to a wall thickness of 0.1 mm-1.2 mm, such as 0.5 mm-0.8 mm, length of 5 cm-50 cm, width of 5 cm-50 cm and depth of 2 cm-20 cm.

Oil and Grease Resistance Test

Oil and grease testing was performed using the test method based on standard ASTM F119-82:2015. Grease testing was performed using the test method based on standard TAPPI T559: 2012.

As can be seen from FIG. 1 the wet moulded and thermoformed (in thickness direction) article (2D article/sheet) of the present invention (composition B) exhibits increased oil resistance compared to the zero test (only fiber stock comprising cellulosic fibers, no chemicals added) and comparative composition A.

The foregoing description has provided by way of non-limiting examples of particular implementations and embodiments a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed example embodiments may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A method for improving grease and oil resistance of a moulded fiber based article, the method comprising:

obtaining a fiber stock comprising cellulosic fibers, introducing to the fiber stock a composition comprising a synthetic polymer component, which is a copolymer of acrylamide and at least one anionic monomer, the polymer component having an anionicity of 1-60 mol-%, and a cationic polymer component, the synthetic polymer component and cationic polymer component providing the composition with a charge density in the range of 0.05-1 meq/g, when measured at pH 2.8, and −0.2-−3 meq/g, when measured at pH 7.0, introducing polyamidoamine-epichlorohydrin, glyoxalated polyacrylamide, starch or a mixture thereof to the fiber stock, and moulding the fiber stock, wherein the moulding comprises wet forming, wet moulding, vacuum forming, vacuum moulding, extrusion forming, extrusion moulding, thermoforming, dry moulding, hot pressing, hot press drying, hot moulding, heat pressing, heat moulding, thermomoulding or a combination thereof, wherein the composition comprising the synthetic polymer component and the cationic polymer component, the synthetic polymer component and the cationic polymer component providing the composition with the defined charge densities, is introduced to the fiber stock in an amount of 5-50 kg/t, based on dry weight of the fiber stock.

2. The method according to claim 1, wherein pigment material is introduced to the fiber stock.

3. The method according to claim 1, wherein the fiber stock is formed to a sheet.

4. The method according to claim 3, wherein the sheet is formed to a three-dimensional, 3D, article.

5. The method according to claim 1, wherein the fiber stock is moulded to a three-dimensional, 3D, article.

6. The method according to claim 1, wherein the fiber stock is wet moulded and the wet moulded fiber stock is moulded to a three-dimensional, 3D, article.

7. The method according to claim 1, wherein polyamidoamine-epichlorohydrin, glyoxalated polyacrylamide, starch or a mixture thereof and the composition are introduced sequentially to the fiber stock.

8. The method according to claim 1, wherein the polyamidoamine-epichlorohydrin, glyoxalated polyacrylamide, starch or a mixture thereof is introduced to the fiber stock before introducing the composition to the fiber stock.

9. The method according to claim 1, wherein the composition is introduced to the fiber stock followed by introducing the polyamidoamine-epichlorohydrin, glyoxalated polyacrylamide, starch or a mixture thereof to the fiber stock.

10. The method according to claim 1, wherein the synthetic polymer component and cationic polymer component are introduced sequentially to the fiber stock.

11. The method according to claim 1, wherein the cationic polymer component is introduced to the fiber stock before introducing the synthetic polymer component.

12. The method according to claim 1, wherein the synthetic polymer component is introduced to the fiber stock before introducing the cationic polymer component.

13. The method according to claim 1, wherein the synthetic polymer component, the cationic polymer component and the polyamidoamine-epichlorohydrin, glyoxalated polyacrylamide, starch or a mixture thereof are introduced sequentially to the fiber stock.

14. The method according to claim 1, wherein the synthetic polymer component and the cationic polymer component are introduced sequentially to the fiber stock followed by introducing the polyamidoamine-epichlorohydrin, glyoxalated polyacrylamide, starch or a mixture thereof to the fiber stock.

15. The method according to claim 1, wherein the polyamidoamine-epichlorohydrin, glyoxalated polyacrylamide, starch or a mixture thereof is introduced to the fiber stock followed by introducing the synthetic polymer component and the cationic polymer component sequentially to the fiber stock.

16. The method according to claim 1, wherein the synthetic polymer component is introduced to the fiber stock followed by introducing the polyamidoamine-epichlorohydrin, glyoxalated polyacrylamide, starch or a mixture thereof to the fiber stock followed by introducing the cationic polymer component to the fiber stock.

17. The method according to claim 1, wherein the cationic polymer component is introduced to the fiber stock followed by introducing the polyamidoamine-epichlorohydrin, glyoxalated polyacrylamide, starch or a mixture thereof to the fiber stock followed by introducing the synthetic polymer component to the fiber stock.

18. The method according to claim 1, wherein the polyamidoamine-epichlorohydrin, glyoxalated polyacrylamide, starch or a mixture thereof is introduced in an amount of 1-8 kg/t, based on the dry weight of the fiber stock.

19. The method according to claim 1, wherein before introducing the composition and the polyamidoamine-epichlorohydrin, glyoxalated polyacrylamide, starch or a mixture thereof to the fiber stock pH of the fiber stock is adjusted to pH value 5-9.

20. The method according to claim 1, wherein conductivity of the fiber stock is adjusted to 0.05 mS/cm-6 mS/cm before introducing the composition and the polyamidoamine-epichlorohydrin, glyoxalated polyacrylamide, starch or a mixture thereof to the fiber stock.

21. The method according to claim 1, wherein sizing chemical, fixative or a mixture thereof is introduced to the fiber stock.

22. The method according to claim 1, wherein an amphoteric polymer having both anionic and cationic groups, or an interpenetrating polymer network material providing the charge densities is introduced to the fiber stock.

23. A moulded fiber based article, wherein the moulded fiber based article is moulded by a method comprising wet forming, wet moulding, vacuum forming, vacuum moulding, extrusion forming, extrusion moulding, thermoforming, dry moulding, hot pressing, hot press drying, hot moulding, heat pressing, heat moulding, thermomoulding or a combination thereof, and wherein the moulded fiber based article comprises a composition comprising:

a synthetic polymer component, which is a copolymer of acrylamide and at least one anionic monomer, the polymer component having an anionicity of 1-60 mol-%, and a cationic polymer component, the synthetic polymer component and cationic polymer component providing the composition with a charge density in the range of 0.05-1 meq/g, when measured at pH 2.8, and −0.2--3 meq/g, when measured at pH 7.0, polyamidoamine-epichlorohydrin, glyoxalated polyacrylamide, starch or a mixture thereof, and pigment material, wherein amount of the composition in the moulded fiber based article is 0.5 wt. %-10 wt. %, based on the dry weight of the moulded fiber based article, wherein amount of the polyamidoamine-epichlorohydrin, glyoxalated polyacrylamide, starch or a mixture thereof in the moulded fiber based article is 0.05 wt. %-0.8 wt. %, based on dry weight of the moulded fiber based article, and wherein amount of the pigment material in the moulded fiber based article is 0.01 wt. %-5 wt. %, based on dry weight of the moulded fiber based article, or wherein the moulded fiber based article is produced with the method according to claim 1.

24. The moulded fiber based article according to claim 23, wherein the moulded fiber based article comprises food packages, food service items drink packages or goods packages.

* * * * *